US005883464A

United States Patent [19]

Rijkers

[11] Patent Number: 5,883,464

[45] **Date of Patent: *Mar. 16, 1999**

[54] THIN-TYPE DISPLAY DEVICE HAVING A WINDOW FRAME

[75] Inventor: Henricus C.J.A. Rijkers, Eindhoven, Netherlands

[73] Assignee: U.S. Philips Corporation, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 768,349

[22] Filed: Dec. 17, 1996

[30] Foreign Application Priority Data

Dec. 22, 1995 [EP] European Pat. Off. ..... 95203609

[51] Int. Cl.[6] ..... H01J 29/87; H01J 9/18

[52] U.S. Cl. ..... 313/496; 313/422; 445/25

[58] Field of Search ..... 313/496, 493, 313/634, 422, 482, 495, 497; 445/25

[56] References Cited

U.S. PATENT DOCUMENTS

| | | | |
|---|---|---|---|
| 4,139,250 | 2/1979 | Jacobs et al. | 445/25 |
| 4,362,967 | 12/1982 | Littwin et al. | 313/493 |
| 4,395,244 | 7/1983 | Glaser | 445/25 |
| 4,427,479 | 1/1984 | Glaser et al. | 445/25 |
| 4,872,863 | 10/1989 | Van Der Avoort | 313/482 |
| 5,635,795 | 6/1997 | Itoh et al. | 313/496 |

FOREIGN PATENT DOCUMENTS

| | | | |
|---|---|---|---|
| 0484185A1 | 11/1991 | European Pat. Off. | H01J 29/87 |

OTHER PUBLICATIONS

*6" Diagonal Microtips Fluorescent Display for T.V. Applications*, R Meyer Eurodisplay pp. 374–377 1990 (no month).

*Primary Examiner*—Sandra O'Shea
*Assistant Examiner*—Michael Day
*Attorney, Agent, or Firm*—Bernard Franzblau

[57] ABSTRACT

A display device is provided with a window frame (7). This window frame is arranged on the front wall (2). A vacuum-tight connection (10) is formed between the window frame and the front wall, and between the window frame and a rear wall (3) or a projecting portion of an intermediate element (4). The window frame reduces the risk of leakage, reinforces the construction and makes possible an improved method of manufacturing the display device.

11 Claims, 2 Drawing Sheets

THIN-TYPE DISPLAY DEVICE HAVING A WINDOW FRAME

BACKGROUND OF THE INVENTION

The invention relates to a thin-type display device comprising a flat first wall, a second wall, means for generating electrons, and at least one flat, apertured element between the first wall and the second wall, the space between the first wall and the second wall being sealed vacuum-tight.

The invention further relates to a method of manufacturing a display device.

In U.S. Pat. No. 4,139,250, a description is given of a display device of the type mentioned in the opening paragraph, and of a method of manufacturing such a display device. The known display device, which is a gas-discharge display device, comprises a front plate (the first wall) and a back plate (the second wall) between which one or more plate-shaped, apertured spacing members are situated. The space between the first wall and the second wall is sealed vacuum-tight. A discharge gas is present in said space.

Other display devices of the type mentioned above are, for example, thin display devices which operate according to the field-emission principle, LCD devices which are driven by means of plasma discharges, and display devices in which electrons are guided from electron sources, via electron-transport ducts, to phosphor elements.

In the known display device, the first wall and the second wall are fused together by means of a glass-solder connection. This connection is formed by stacking up the first wall, the second wall and the spacing member, the first wall being slightly smaller than the second wall, and by subsequently providing the side faces of the first wall with a glass suspension in a solution, for example amyl acetate. After evaporation of the amyl acetate, this solution is heated for some time to approximately 440° C., as a result of which the material melts without crystallizing, whereafter said material is exposed to a high temperature (approximately 485° C.), thus causing it to liquefy and crystallize.

A disadvantage of the known display device is that the glass suspension is difficult to provide, and that there is a relatively great risk of leakage. A leak in the vacuum connection causes failure of the display device.

OBJECTS AND SUMMARY OF THE DRAWINGS

It is an object of the invention to provide a display device having a more reliable vacuum-tight connection. This leads to a smaller failure percentage.

To this end, a display device in accordance with the invention is characterized in that the display device comprises a window frame which is provided around the first wall, which window frame has an inner portion which extends parallel to the first wall, in that a vacuum-tight connection is formed between the first wall and said inner portion, in that the window frame comprises an outer portion which extends transversely to and beyond said first wall, and in that said outer portion is connected by means of a vacuum-tight connection to a flat part of the display device which extends beyond the first wall.

In the display device in accordance with the invention, a flat part, for example the second wall, extends beyond the first wall. A window frame, hereinafter also referred to as a "frame", is arranged on said first wall, which frame is connected in a vacuum-tight manner to the outer surface of the first wall and, on the other side, to said projecting flat part.

In the known display device, the various parts are stacked, whereafter the glass suspension is provided around the first wall. The glass suspension should provide a vacuum-tight connection between the first wall, the second wall and the flat element. During interconnecting the parts, the glass suspension liquefies. However, the glass suspension has a high viscosity, i.e. it is syruplike. As a result, during interconnecting the parts, the glass suspension penetrates hardly, if at all, between the parts (front wall, rear wall and flat element). As a result, the reliability of the connection, i.e. whether the connection formed is vacuum-tight or not, is unsatisfactory, in particular for large display devices (in excess of 10") due to the relatively large length of the vacuum connection. Moreover, even if a good vacuum-tight connection is made, the connection is relatively weak with respect to shear forces, i.e. forces acting on the flat parts in a direction parallel to the parts. Such shear forces may occur, for example, when the thin display device is suspended.

In the display device in accordance with the invention, a window frame is arranged on the first wall. In this case, the vacuum-tight connections are situated, on the one hand, between an outer surface of the first wall and the inner side of the window frame and, on the other hand, between a projecting flat part and the outer edge of the window frame. It is not necessary to make vacuum-tight connections between the flat parts.

In a display device in accordance with the invention, the vacuum-tight connections are formed between flat, substantially parallel surfaces. By virtue thereof, the risk of leakage is reduced substantially, which results in a lower failure percentage. In addition, the vacuum-tight connections exhibit a higher resistance to shear forces.

Apart from the above-mentioned advantages of the window frame, the invention has still other advantages. The window frame increases the sturdiness of the display device, thereby reducing breakage of and damage to the display device. Breakage of and damage to the display device lead to failure of said display device.

Preferably, the window frame is in a single piece. The window frame may consist of two or more parts which are, for example, interconnected. By solidly constructing the window frame, i.e. in a single piece, the sturdiness of the window frame is increased, thereby further reducing the risk of breakage.

In a preferred embodiment of the invention, the window frame is provided with an exhaust tube. This leads to a reduction of the thickness of the display device. In addition, the risk of breakage of the exhaust tube is reduced.

The window frame is preferably made of a material having approximately the same coefficient of thermal expansion as that of the first wall.

The display device is exposed to heat during its manufacture. If the material of the window frame has approximately the same coefficient of thermal expansion as the first wall, they both expand to the same extent upon heating. By virtue thereof, thermal. stresses between these elements are precluded. Such thermal stresses may cause breakage or leaks and hence failure.

In a preferred embodiment, the inner surface of the window frame is provided with a reference face against which the flat part is positioned.

In this preferred embodiment, the window frame is provided with a reference face. By virtue thereof, the position of the flat part relative to the first wall can be accurately determined.

In a further embodiment, the transmission of the window frame differs from the transmission of the front wall.

By virtue thereof, the display device can be provided with a dark edge.

In yet another embodiment, the window frame is provided with means for securing the display device in a housing.

The vacuum-tight connections in the display device in accordance with the invention may be, for example, thermocompression bonds, which are formed by providing a thin layer of a metal between the parts to be interconnected, whereafter the metal is heated to a temperature of approximately 90% of the melting temperature of the metal, while exerting some pressure, and a connection being made by means of diffusion of the metal in the material of the parts to be interconnected. Preferably, however, the vacuum-tight connections are formed by solder-glass connections.

It is noted that in the display device in accordance with the invention, the reliability of the vacuum-tight connections is improved without a reduction of the accuracy with which the parts, in particular the front wall and the rear wall, are positioned relative to the flat element. Constructions in which vacuum-tight connections are made between the front wall, the rear wall and the flat element have the disadvantage that the distance between the parts, viewed in a direction transverse to the flat parts, exhibits a variation, both between different display devices and in one display device. The thickness of the connection between said flat parts depends substantially on the connecting material used, and the method is difficult to control. In practice, this causes variations in the thickness of the connections and, as a result, variations in the distance between the parts. In addition, the risk that the parts are displaced relative to each other is increased. This can be attributed to the fact that during interconnecting the parts, a viscous layer is present between the parts. Both effects adversely affect the quality and uniformity of the image displayed and may cause failure.

The method of manufacturing a thin-type display device, in which a first and a second wall and an intermediate flat element are interconnected, is characterized in accordance with the invention in that a window frame is provided with a first and a second pre-glazed surface, and, subsequently, the first and the second wall and the flat element are stacked, whereafter the window frame is arranged on the first wall, so that the pre-glazed surfaces engage, respectively, a surface of the first wall and a surface of a part of the flat element or of the second wall, which part extends beyond the first wall, whereafter the assembly is heated, thereby forming glass-solder connections between the first wall and the window frame and between the part and the window frame.

The method in accordance with the invention has the advantage that in a display device manufactured in accordance with the invention, oxidation and/or contamination can be precluded and/or reduced in locations where, in accordance with the known method, oxidation or contamination of parts, such as electrodes, is difficult to preclude.

The glass suspension contains a binder, for example, nitrocellulose. This binder is burnt out during heating of said glass suspension to a high temperature. In order to burn out said binder, use must be made of air or of another oxygen-containing gas. However, oxygen, in combination with a high temperature, causes undesirable oxidation in the display device, for example of emissive surfaces or electrodes. In addition, residues of the burnt-out binder precipitate in the display device. Also such precipitates have an uncontrollable, negative effect on the operation of the display device. In the method in accordance with the invention, the surfaces to be interconnected are pre-glazed. This means that one or both parts (window frame, first wall and/or projecting flat part) on the surfaces to be interconnected is (are) provided with a glass suspension, whereafter a heating step is carried out in which the material of the glass suspension melts without crystallizing. This first step can be carried out without the necessity of exposing other parts of the display device to high temperatures in combination with oxygen. The binder is burnt out during this first heating step. Subsequently, the parts (front wall and rear wall and the intermediate flat element) are stacked, the window frame is provided on the first wall and the glass-solder connections are made by a heating step in which the glass-solder connection crystallizes. No incineration residues can precipitate in the display device. In addition, the period of time during which the display device as a whole is exposed to high temperatures is generally reduced, which results in a reduction of oxidation. Preferably, the second heating step is carried out in an oxygen-free atmosphere (which is to be understood to include a vacuum). In this case, oxidation occurs hardly, if at all. Preferably, the window frame is pre-glazed.

These and other aspects of the invention will be apparent from and elucidated with reference to the embodiments described hereinafter.

The drawings are schematic and, in general, not drawn to scale.

DESCRIPTION OF THE PREFERRED EMBODIMENTS

Figure 1:
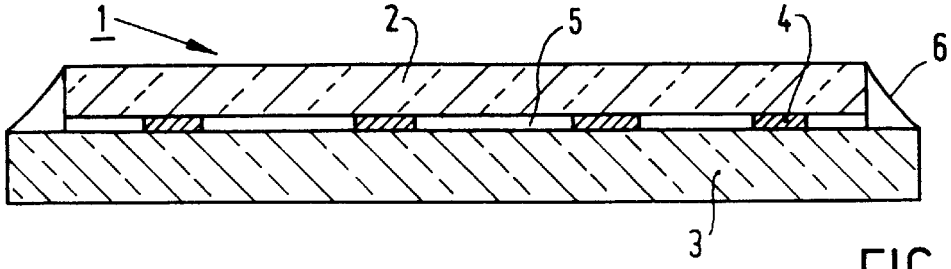
FIG. 1 PRIOR ART
FIG. 1 is a sectional view of a known display device.

FIG. 1 is a sectional view of a display device which is know from U.S. Pat No. 4,139,250. A display device 1 comprises a first wall 2, a second wall 3 and a spacer plate 4. This spacer plate is provided with apertures 5. The second wall 3 is slightly larger than the first wall 2. A vacuum connection 6 (sealing material) is circumferentially provided. The first wall and the second wall will hereinafter also be referred to as "front wall" and "rear wall", respectively. The method of providing the walls is described hereinabove, and for a more detailed description reference is made to U.S. Pat No. 4,139,250. The disadvantage of the known display device is that the reliability of the vacuum connection formed is relatively low. This can probably be attributed to the high viscosity of the glass suspension. In the liquid state, said glass suspension is very syruplike. As a result, during the connecting process, the glass suspension penetrates hardly, if at all, between the parts (front and rear wall and flat element). Consequently, a small scratch on the surfaces to be interconnected is not filled properly, so that leakage may occur. Moreover, in particular relatively large, flat display devices (having a diagonal in excess of, for example, 15"), whose parts are generally made of glass or of ceramic materials, should be handled with care since breakage frequently occurs.

Figure 2:
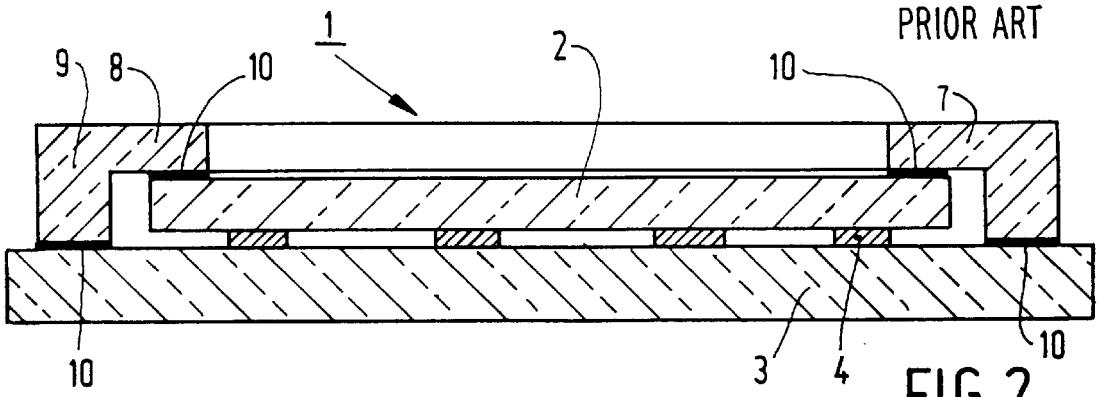
FIG. 2 is a sectional view of a display device in accordance with the invention.

FIG. 2 is a sectional view of a display device in accordance with the invention. Display device 1 is provided with a window frame 7 which extends around the first wall 2. This window frame comprises a first (inner) portion 8 which extends parallel to the front wall 2, and a second (outer) portion 9 which extends transversely to the front wall 2. Vacuum connections 10 interconnect the first wall 2 and the portion 8, and the second wall 3 and the portion 9. In the display device in accordance with the invention, the vacuum-tight connections are formed between flat, substantially parallel surfaces. As compared to the seals in the known display device, the sealing effect of the connections is improved substantially. During the connecting process, the glass suspension spreads out between said parallel surfaces. By virtue thereof, the risk of leakage is reduced substantially, which results in a lower failure percentage. In addition, said vacuum-tight connections exhibit a better resistance to shear forces. Shear forces occur, for example, if the display device is suspended ("picture on the wall"). It is very advantageous that, if the parts 2, 3 and 4 are accurately aligned relative to each other, the making of the vacuum connections 10 does not disturb this alignment. This can be attributed to the fact that there is no glass suspension between these parts 2, 3 and 4. It is noted that a good alignment of the parts 2, 3 and 4 is very important. The distances between the various parts are also factors which determine the image displayed, and variations in these distances manifest themselves as differences in the quality and/or uniformity of the image displayed. If there would be a vacuum-tight connection between the parts 2 and 4 and/or 3 and 4, for example a glass-solder connection 10, then the thickness of the glass-solder connection is also a factor which determines the distance between said parts. Thus, variations in the thickness of the glass-solder connection, which are difficult or impossible to prevent, lead, in such a construction, to variations in the quality of the display device and maybe to failure. Further, in such situations there is a viscous layer between the parts 2 and 3 and/or 3 and 4 which are being interconnected. As a result, the parts can move relatively easily with respect to each other. In the display device in accordance with the invention none of these effects occur. There may be variations in the thickness of the connection 10, however, these variations do not or hardly influence the distances between the stack of adjoining parts 2, 3 and 4. During interconnecting the parts, there is no viscous layer between the parts 2 and 3 and/or 3 and 4, so that these parts (almost) do not move relative to each other.

Figure 3:
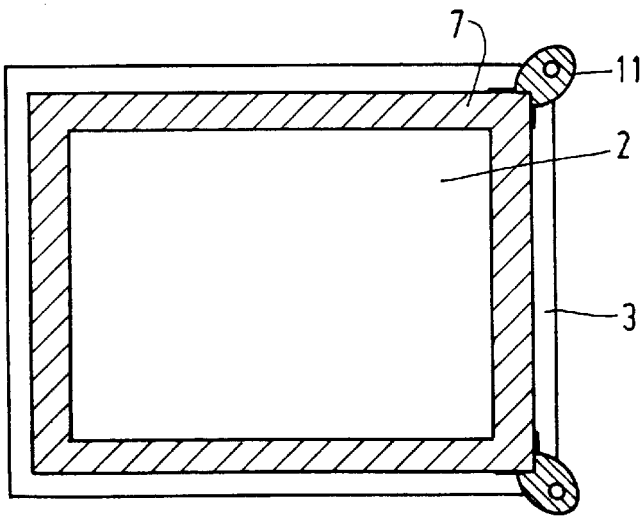
FIG. 3 is a front view of a display device in accordance with the invention.

A further advantage is that the window frame 7 reinforces the display device (thereby reducing the risk of breakage) and the first wall gives protection against scratches. FIG. 3 shows a front view of the display device of FIG. 2. In this example, the window frame is darker than the first wall 2, which leads to an increase of the apparent contrast and the apparent brightness of the image displayed. In this example, the window frame is provided with a corner element 11 (two of which are shown). These corner elements can be used to suspend the display device in a housing. Particularly in such an embodiment, it is important that the connections 10, 12 can withstand shear forces.

Figure 4:
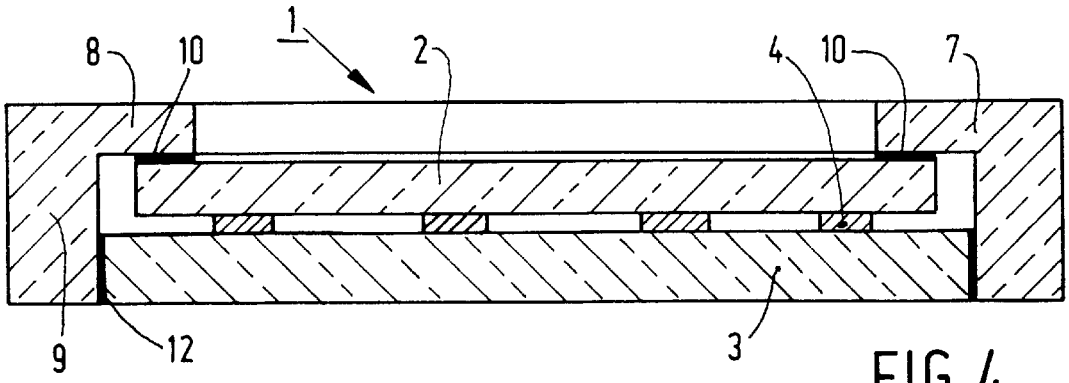
FIG. 4 shows a further example of a display device in accordance with the invention.

FIG. 4 is a sectional view of a further example of a display device in accordance with the invention. In this example, the portion 9 is connected to the rear wall 3. In this embodiment, the reinforcing effect of the window frame is greater than in the embodiment of FIG. 2, so that in this respect this embodiment is preferred. However, making the connection 10, 12 is more difficult than in the embodiment shown in FIG. 2. In both embodiments, the vacuum connections 10, 12 are made between two flat, substantially parallel surfaces, which reduces the risk of leakage.

Figure 5:
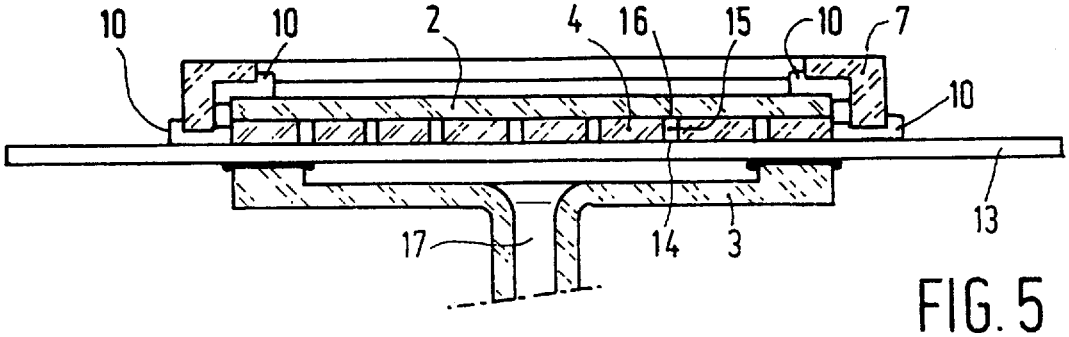
FIGS. 5 and 6 show other examples of a display device in accordance with the invention.

FIG. 5 is a sectional view of another example of a display device in accordance with the invention. In the examples of FIGS. 2 and 3, there is only one spacer between the front wall and the rear wall. In the example of FIG. 5, a spacer element 4 and a plate-shaped element 13 are provided between the front wall 2 and the rear wall 3. This plate-shaped element has, in this example, electron-emitting pointed elements 14 which, in operation, emit electrons under the influence of an electric field, which electrons pass through apertures 15 in spacer 4 and impinge on phosphor elements 16 on the inner surface of the front wall 2. Such display devices are commonly referred to as field-emission type display devices. In this example, the plate-shaped element 13 projects from the front wall 2. By means of connections 10, the window frame 7 is connected vacuum-tight to the front wall 2 on the one hand and to the plate 13 on the other hand. In this example, plate 13 is provided with apertures, which are not shown. The display device can be evacuated via the exhaust tube 17. The distance between the electron-emitting elements 14 and the phosphor elements 16 is also a factor which determines the intensity of the image displayed. Differences in this distance adversely affect the uniformity of the image displayed. A displacement of the elements 14 and 16 and/or of the apertures 15 relative to the elements 14 and/or 16 also leads to a reduction of the quality of the image displayed.

Figure 6:
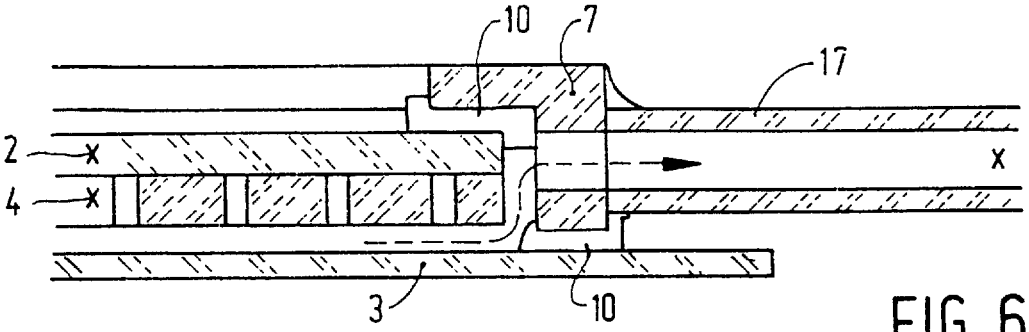

FIG. 6 shows yet another example of a display device in accordance with the invention. In this example, the window frame 7 is provided with an exhaust tube 17. The advantage of this embodiment relative to, for example, the embodiment shown in FIG. 5 is that the thickness of the display device is reduced. In this Figure, a dotted arrow shows how the evacuation process is carried out. In this example, a plate comprising ducts for the evacuation of the display device is situated between the rear wall 3 and the flat element 4. The rear wall 3 may be provided with electron-emitting elements 14 as shown in FIG. 5.

Figure 7:
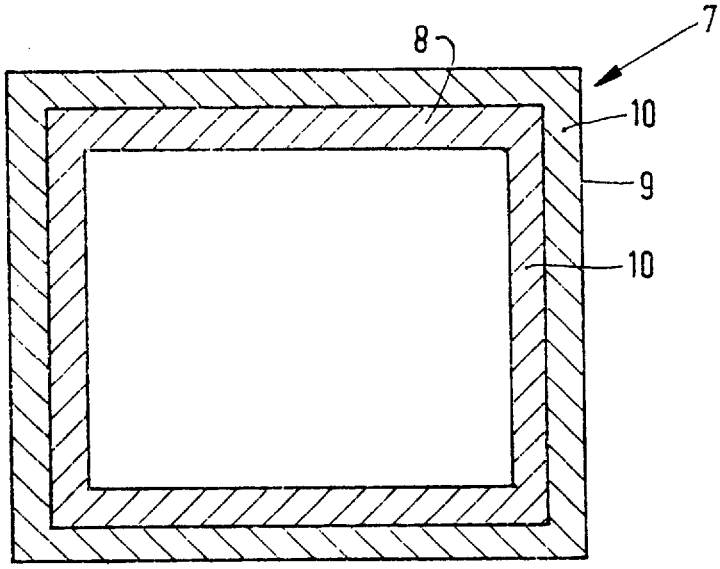
FIG. 7 is a view of a pre-glazed window frame.

FIG. 7 shows a front view of a pre-glazed window frame 7. The parts 8 and 9 are pre-glazed. This can be achieved by providing parts 8 and 9 with a glass suspension in a solution, for example amyl acetate. A suitable glass suspension is, for example, the suspension sold by Corning under the trade name Pyroceram 7590. After evaporation of the amyl acetate, this solution is heated to approximately 390° C. for some time, as a result of which the material melts without crystallizing. The binder (in this example nitrocellulose E-1440) present in the glass suspension is burnt out in this process step.

Figure 8:
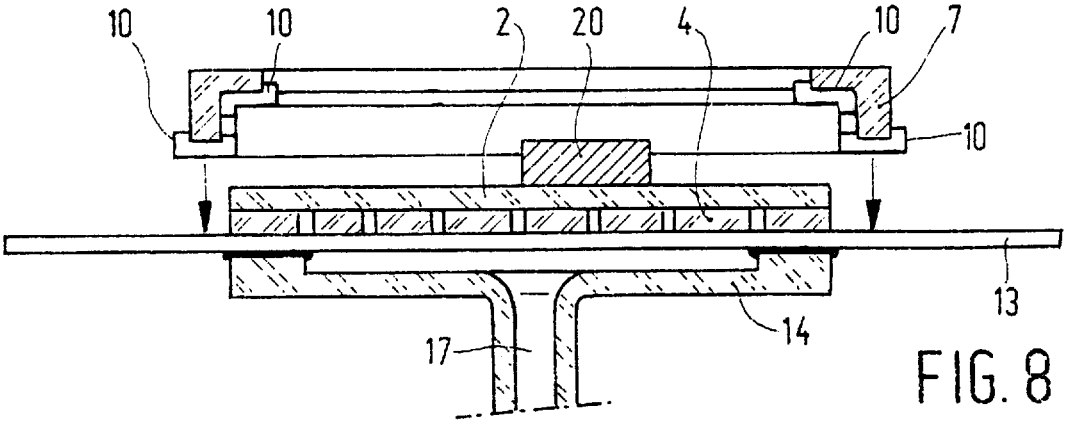
FIG. 8 illustrates the method in accordance with the invention.

FIG. 8 illustrates the method in accordance with the invention. Front wall 2, intermediate element 4 and, in this example, intermediate element 13 to which rear wall 14 is secured, are stacked. FIG. 8 schematically shows that a weight 20 can be used in this process. The pre-glazed window frame 7 (pre-glazed elements 10 are shown in the Figure), is arranged on the front wall 2. Subsequently, the assembly is heated to a high temperature (for example approximately 440° C.), thus causing the pre-glazed elements to melt and crystallize, so that the connections, as shown in FIG. 5, between window frame 7, front wall 2 and plate 13 are formed. The advantage, relative to the known method, is that the display device and, in particular, parts such as electron-emitting surfaces and electrodes are not exposed to and contaminated by incineration residues of the binder of the glass suspension and, in addition, that the time during which they have to be exposed to high temperatures is reduced. Exposure to high temperatures may lead to oxidation of parts, for example emissive surfaces or pointed elements. Preferably, the connection between the pre-glazed window frame 7 and the front wall 2 and the plate 13 is established in an oxygen-free atmosphere, such as nitrogen or a vacuum. In this manner, oxidation is precluded. In the example shown, the glazed surfaces of the window frame are substantially parallel. This is a preferred embodiment. During interconnecting, the elements to be interconnected are usually pressed against each other. Advantageously, the pressing force extends transversely (preferably perpendicularly) to the connection surfaces of both connections. In this manner, the risk that parts are displaced relative to each other is reduced. The inner surface of the window frame 7 may be provided with reference faces for elements, such as the intermediate element 4, which can be slid into contact with said reference faces.

It will be obvious that within the scope of the invention, many variations are possible to those skilled in the art. For example, in the Figures the window frame is arranged on the front wall. Within the scope of the invention, it is alternatively possible to arrange a window frame on the rear wall. The use of two window frames, one on the front wall and the other on the rear wall, is also possible. In the method illustrated in FIG. 8, a glass-solder connection is used, and glass suspension crystallizes when the connections are made. Crystallization crystallizes when the connections are made. Crystallization is an irreversible process, i.e. remelting of the connections is generally impossible. Within the scope of the method in accordance with the invention, use can alternatively be made of a glass suspension which does not crystallize. Connections made by means of such glass suspensions are reversible. The use of a glass suspension which crystallizes has the advantage that the crystallized connection is stronger. The use of a glass suspension which does not crystallize has the advantage that the connection is reversible, i.e. if necessary or desirable, the connection can be broken by exposing the display device to heat.

I claim:

1. A thin-type display device comprising: a stack of flat elements including a flat first wall, a second wall, and at least one flat, apertured spacer element between the first wall and the second wall, the space between the first wall and the second wall being sealed vacuum-tight, and means for generating electrons, characterized in that the display device comprises a window frame around the first wall, wherein an inner portion of the window frame extends parallel to the first wall, in that a vacuum-tight connection is formed between the first wall and said inner portion, in that the window frame comprises an outer portion which extends transversely to and beyond said first wall, and in that said outer portion is connected by means of a vacuum-tight connection to a flat part of the display device which extends beyond the first wall.

2. A display device as claimed in claim 1, wherein in the window frame is in a single piece.

3. A display device as claimed in claim 1, wherein the window frame includes an exhaust tube.

4. A display device as claimed in claim 1, wherein the vacuum-tight connections are formed by solder-glass connections.

5. The display device as claimed in claim 4 wherein the vacuum-tight connections are formed between substantially parallel surfaces of the flat first wall and the inner portion of the window frame and between a flat part of the second wall and the outer portion of the window frame.

6. The display device as claimed in claim 4 wherein the first wall and the window frame are each made of a glass material having approximately the same coefficient of thermal expansion.

7. A display device as claimed in claim 1, wherein the elements of the stack of flat elements adjoin one another and the vacuum-tight connections are formed between substantially parallel surfaces.

8. A display device as claimed in claim 1, wherein the window frame is made of a material having approximately the same coefficient of thermal expansion as that of the first wall.

9. A display device as claimed in claim 1, wherein the first wall is provided with phosphor elements and the flat element is provided with apertures corresponding to said phosphor elements.

10. The display device as claimed in claim 1 wherein said flat first wall is made of glass, the second wall is made of glass or a ceramic material and the window frame is made of glass.

11. The display device as claimed in claim 1 wherein said outer portion of the window frame is connected by said vacuum-tight connection to a flat part of the second wall which extends beyond the first wall.

* * * * *